United States Patent [19]

Sheppard et al.

[11] Patent Number: 4,685,404

[45] Date of Patent: Aug. 11, 1987

[54] SLAGGING COMBUSTION SYSTEM

[75] Inventors: Douglas B. Sheppard, Torrance; Albert Solbes; John C. Stansel, both of Rancho Palos Verdes; Lance E. Hill, Torrance, all of Calif.

[73] Assignee: TRW Inc., Redondo Beach, Calif.

[21] Appl. No.: 788,929

[22] Filed: Oct. 18, 1985

Related U.S. Application Data

[63] Continuation of Ser. No. 670,417, Nov. 13, 1984, abandoned.

[51] Int. Cl.[4] ..... F23D 1/00

[52] U.S. Cl. ..... 110/265; 75/26; 266/172; 431/9; 110/263; 110/347; 110/266

[58] Field of Search ..... 110/260–265, 110/347; 75/26; 266/172; 431/9

[56] References Cited

U.S. PATENT DOCUMENTS

| | | | |
|---|---|---|---|
| 2,357,301 | 9/1944 | Bailey et al. | 122/336 |
| 2,357,302 | 9/1944 | Kerr et al. | 122/263 |
| 2,357,303 | 9/1944 | Kerr et al. | 122/235 |
| 2,777,407 | 1/1957 | Schindler . | |
| 2,804,854 | 9/1957 | Wootton et al. | 122/479 |
| 2,808,012 | 10/1957 | Schindler . | |
| 2,858,780 | 11/1958 | Sifrin et al. . | |
| 2,971,480 | 2/1961 | Sage . | |
| 3,199,476 | 8/1965 | Nettel . | |
| 4,217,132 | 8/1980 | Burge et al. . | |
| 4,599,955 | 7/1986 | Hopworth et al. | 110/265 |

FOREIGN PATENT DOCUMENTS 714925 9/1954 United Kingdom .

*Primary Examiner*—Henry C. Yuen

*Attorney, Agent, or Firm*—John P. Grinnell; Benjamin DeWitt

[57] ABSTRACT

There is provided a slagging coal combustion system suitable for retrofitting boilers, furnaces and industrial-process heat generators originally designed to burn oil or gas. It comprises a primary combustion chamber into which oxidizer and fuel are injected to provide high-velocity, rotational-flow combustion zones, such that the fuel is burned substoichiometrically, while in flight, with up to 90% of the resultant ash being removed as molten ash. The combustion products pass from the primary chamber to chamber where slag is removed and the gaseous products are passed to end-use equipment. A coal-fired precombustor subsystem feeds partially-heated air as the oxidizer to the primary combustion chamber supply of oxidizer, at any selected temperature within the range from about 1200° F. to about 2000° F. The stoichiometry of this precombustor and the velocity and mass-flow rates of its output stream are independently controllable.

14 Claims, 11 Drawing Figures

SLAGGING COMBUSTION SYSTEM

CROSS-REFERENCE TO RELATED APPLICATIONS

This is a continuation of application Ser. No. 670,417 filed Nov. 13, 1984, now abandoned.

BACKGROUND OF THE INVENTION

Conventional coal-burning boiler plants and industrial furnaces combust the coal in a reaction zone directly within the furnace, wherein combustion temperatures are high enough to keep slag above its fusion temperature. They are normally operated at an overall stoichiometry greater than 1, which results in generation of substantial quantities of the oxides of nitrogen and the oxides of sulfur, as well as relatively high emission of particulates into the atmosphere. Such furnaces have relatively low energy release per unit-volume and count on the use of refractories to protect against slag erosion. They commonly operate at relatively very low power densities, requiring large-volume "fire boxes" for burning out the carbon content of the fuel, collecting the residual slag and extracting energy from the flame.

In recent years, oil prices have increased by about a factor of ten. Many electric-utility boiler plants and industrial furnaces are caught in a cost squeeze. Trona kilns, for example, require vast quantities of thermal energy; operators of such industrial processes have large capital investments in facilities that are not economically viable at current oil and gas prices.

Conversion of these boilers and furnaces, to burn coal rather than oil or gas, would provide very substantial energy-cost savings; and this can often avoid plant closing, abandonment of capital investment and loss of jobs in the community. But, attempting to burn coal in multi-megawatt boilers originally designed and constructed for oil or gas presents several difficulties that have been thought to be insurmountable: Slag and fly-ash from conventional coal burning will coat the water tubes, sharply reducing efficiency; Emission of sulfur oxides (herein $SO_x$) and/or nitrogeneous oxides ($NO_x$) is not merely objectionable socially but, under current clean-air regulations, often prohibited in the urban and semi-urban locales where electricity-generating boiler plants are commonly located. Most often, the space available for installation of coal handling and combustion equipment is severely limited. And, boilers originally designed for oil and gas usually have no provision for slag collection and disposal.

Thus, our society has developed a significant social and economic need for a process and apparatus for conversion (retrofit) of pre-existing boilers and furnaces to adapt them to burn coal. Any such system, to be economically, technically and environmentally acceptable should meet the following requirements:

High power density:—ablout 1.0 million Btu/hour per cubic foot of volume in the primary combustion chamber.

Low $No_x$:—Consistently less than 450 ppmv and, preferably, less than 250 ppmv in the gases emitted into the atmosphere.

Low $SO_x$:—Substantially lower than heretofore achievable with conventional combustors and, preferably, reduction of the sulfur-compounds content of the stack gases by about 50 to 90 percent.

Removable of Noncombustibles:—Capture, and removal from the gaseous products of combustion, of 70% to 90% of the noncombustible-minerals content of the fuel before the gaseous products are conducted to the end-use furnace or boiler, depending on the requirements of the specific end use.

Carbon Carryover:—Conversion of substantially all carbon to oxides of carbon before the gaseous products pass to the boiler or other heat-utilization equipment.

Durability:—Protection of the walls of the combustor such that deleterious corrosion and/or erosion of the walls is kept within commercially-acceptable limits.

Thermal Efficiency:—Delivery to the end-use equipment of a gaseous-products stream having about 85 to 90 percent of the chemical potential energy of the carbonaceous fuel. Preferably this energy is delivered partly as sensible heat and partly in the form of carbon monoxide and hydrogen contained in the gaseous-products and readily combustible, to completion, in the end-use equipment.

The present invention provides a system meeting the foregoing requirements.

U.S. Pat. No. 4,217,132 to Burge et al, incorporated herein by reference, describes an apparatus for combusting carbonaceous fuels that contain noncombustible mineral constituents, separating such constituents as liquid slag and conveying a stream of hot combustion products to a thermal energy utilization equipment, such as a boiler. In the Burge et al apparatus solid carbonaceous fuel (e.g. powdered coal) is injected into a combustion chamber and, simultaneously, a stream of oxidizer (e.g. preheated air) is introduced tangentially into the chamber to produce high velocity swirling flow conditions therein suitable for centrifugally driving most of the liquid slag to the inside walls of the chamber. The apparatus described in the '132 patent is a first-generation, high-power-density slagging combustor. The present invention relates to improvements in slagging combustors, resulting from extensive study and development including recognition of requirements peculiar to adapting slagging combustors to industrial furnaces and electric-utility boilers originally designed and constructed to use oil and/or natural gas. Our apparatus, described herein, is a slagging combustor, belonging to the same general class as that disclosed by Burge et al. Our apparatus includes several improvements and is, to the best of our knowledge, the only extant technology for simultaneously removing substantially all slag, controlling $NO_x$ and $SO_x$ emissions, and avoiding carryover of unburned carbon and other particulate, while operating at high efficiency, having commercially-acceptable durability and being small enough to be retrofitted into the limited space normally available in commercial-sized industrial and utility plants.

SUMMARY OF OUR INVENTION

According to the present invention there is provided a compact apparatus and method for efficient combustion of particulate carbonaceous materials at high energy output per unit of volume while removing noncombustibles to the highest levels possible, at the same time minimizing the generation of nitrogen oxides and removing a major portion of the fuel's sulfur content.

Our apparatus comprises, in combination, a precombustion chamber having a first axis; a primary combustion chamber having a second axis which is substantially normal to the first axis; a baffle plate, at the exit end of said chamber, having a keyhole-like aperture; a plenum for recovering slag from the gaseous products of combustion; means to dispose of molten slag; means to deliver product gas to an end-use application; and means for adding supplementary oxidizer to the product gas substantially as it arrives at the end-use equipment.

SHORT DESCRIPTION OF A PREFERRED EMBODIMENT

In a preferred embodiment, the precombustion chamber comprises, first, a cylindrical oxidant addition chamber defined by an end wall of the precombustion chamber and a first apertured baffle, spaced from the end wall. It includes, also, means for tangentially introducing oxidant to the first oxidant addition chamber. A first combustion zone extends along the first axis from the baffle to a second oxidant introduction zone, which comprises a plenum communicating with a duct receiving the effluent of the first combustion zone at the terminus thereof, said duct including means for introduction of a second oxidant stream for admixture with the effluent of the first combustion zone. Nozzle means for introducing particulate fuel extends from the end wall of the precombustion chamber, to approximately the location of the aperture of the first apertured baffle. This nozzle means is adapted to inject particulate carbonaceous material into the first combustion zone at an angle of at least about 45 degrees to the first axis. The second oxidant introduction zone terminates in a duct extending to the primary combustion chamber and is attached thereto by a rectangular opening positioned to enable introduction of oxidant and products of combustion from the precombustion chamber tangentially and adjacent to the walls of the primary combustion chamber. The axis of the precombustion chamber is positioned at an angle to the horizontal sufficient to cause substantially all of the precombustor's products to flow into the primary combustion chamber.

A fuel injector for introduction of particulate carbonaceous material extends into the primary combustion chamber from the end wall thereof.

The primary combustion chamber provides an inner wall surface, adapted to retain, and maintain thereon, a slag layer resulting from combustion of the particulate carbonaceous material. The oxidizer inlet into the primary chamber is positioned to divide effluent of the precombustor into two flows: one directed towards the head end, the other directed towards the exit end. Preferably, the precombustion chamber includes a damper at the rectangular opening, to control the velocity of flow into the primary combustion chamber independently of mass-flow rate and thereby to maintain the inflow tangential velocity at a preselected level.

Products of combustion leave the primary chamber in a high-velocity swirling flow through the keyhole-like aperture of the apertured baffle plate. Also, liquid slag flows through the downwardly extending slot portion of the keyhole aperture. Thus, these products of combustion pass from the primary chamber into an expansion chamber where the gaseous products expand and the velocity of the swirling decreases. Larger lumps and droplets of slag are, therefore, separated from the gaseous combustion products in this expansion chamber and flow, by gravity, to a slag disposal subsystem. Gaseous products of combustion flow upwardly, at relatively low velocity, and are then conducted to an end-use equipment, such as a boiler or furnace. As these gases arrive at the interface between our apparatus and the end-use equipment, supplementary oxidizer is added to the gaseous combustion products, in amounts sufficient to oxidize to completion any as-yet unburned constituents (e.g., carbon monoxide, soot and/or hydrogen) of the flow.

In operation, oxidant is introduced to the precombustor's first mixing chamber and exits the aperture of the first apertured baffle, swirling. The oxidant is mixed with from about 10% to 25% of the total particulate carbonaceous material to be fed to the system. The amount of oxidant introduced into this mixing chamber is normally sufficient for stoichiometric combustion of all the fuel fed to the precombustor. Products of this combustion are diluted by a second oxidant in flow to form an oxidant-rich effluent, e.g., from about 2 to about 5 times the stoichiometry for the precombustor, suitable for injection into the primary combustion chamber and use therein as the sole source of oxidizer for combusting the primary input of carbonaceous fuel. The balance of the particulate carbonaceous material is fed by the fuel injector to the primary combustion chamber at an angle of from about 45 to about 90 degrees to the axis thereof, mixes with the oxidant-rich effluent from the precombustion chamber, which is delivered at a temperature of from about 1200° to about 2000° F. Combustion in this primary combustor is substoichiometric with the total oxidizer fed to the primary combustion chamber being in the range from about 0.7 to about 0.9 of the stoichiometric amount that would be required for combustion of all the combustibles in the fuel. In the primary combustion chamber, combustion occirs substantially in flight with conversion of substantially all noncombustibles to molten slag which, by the whirling action of flow fields within the primary combustion chamber, is centrifugally driven to the walls of the primary combustion chamber and collects thereon as a slag layer whose surface is molten. In steady-state operation, slag flows toward the primary chamber's appertured baffle, through the slotted opening, to the slag-collection means. The hot oxidant inflow from the precombustor is beneficial in deterring the accumulation of frozen slag near the oxidant-inflow aperture. Perhaps more importantly, it maintains a high temperature environment, heated by radiant combustion products, throughout the head-end portion of the primary chamber, thereby assuring prompt and stable fuel combustion closely adjacent the fuel injection assembly and conversion of 85% to 90% of the carbon before the fuel particles reach the wall of the primary chamber. The gaseous products of combustion flow through the aperture of the baffle into the expansion chamber, wherein any large size residue slag is separated from the gaseous product before it is introduced to an end-use apparatus. Supplementary oxidizer is introduced into the gaseous products at the interface with the end-use equipment, so that final combustion of CO and $H_2$ produced in the substoichiometric primary combustor is accomplished as the gaseous products enter the end-use equipment.

In the particularly preferred embodiment of the invention, the precombustion chamber has a length-to-diameter ratio of 3 to 1; the primary combustion chamber has a length-to-diameter ratio of 1.5 to 2 to 1; the expansion chamber has a length-to-diameter ratio of 1 to 1; and the primary chamber has a baffle area ratio in the range from 2:1 to 4:1. As noted above, the total oxygen fed to the primary chamber is, preferably, about 0.7 to about 0.8 of the amount that would be required for complete combustion, to carbon dioxide and water, of all the carbon and hydrocarbons contained in the fuel. Accordingly, the gaseous combustion products leaving the primary combustion chamber contain substantial amounts of carbon monoxide and hydrogen and, therefore, are suitable for further combustion, to completion, in an end-use equipment, e.g., a boiler or industrial furnace. The preferred carbonaceous feed is coal. A sulfur sorbent may be introduced, in a direction opposite to the bulk flow of reactants, into the primary combustion chamber, to enable capture of sulfur-containing constituents of the carbonaceous fuel.

DETAILED DESCRIPTION

Figure 1:
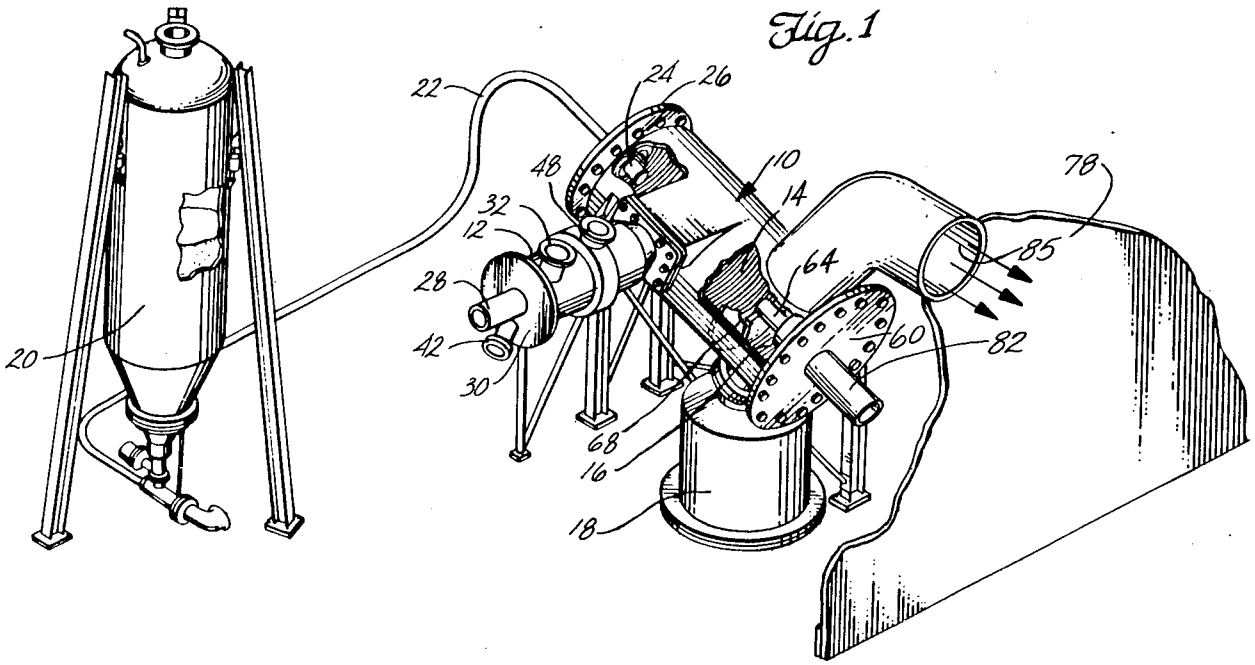
FIG. 1 is a perspective arrangement of the system in relation to an effluent-consuming furnace.

There is provided, in accordance with the present invention, a system employing particular apparatus and methods for efficiently combusting particulate carbonaceous materials and removing solid noncombustibles to the highest levels possible, at the same time minimizing the generation of nitrogen oxides, providing an efficient means to remove sulfur compounds, and collecting and removing 70 to 90% of the molten slag before the gaseous products are introduced into an associated thermal energy utilization equipment.

The achievement of these improvements is brought about by the use of methods and apparatus which prepare the particulate carbonaceous materials and the oxidant used to combust them, for rapid ignition and reaction in fluid dynamic flow fields. The apparatus employed, consists of four mechanical units connected together: a precombustor, a primary combustor, a slag-collection unit and a conduit with an integral secondary burner. All are compact and produce an energy-release rate per unit-volume of apparatus that is much larger than can be achieved in conventional coal-burning furnaces.

By the term "particulate carbonaceous fuel" as used herein, we mean carbon-containing substances that include noncombustible minerals and which can be provided as a fuel in a dispersed state, either suspended in a carrier fluid as free particles, or as a slurry. Representative carbonaceous materials include, among others, coal, char, the organic residue of solid-waste recovery operations, tarry oils that are dispersible in liquid, and the like. All that is required is, that the carbonaceous material to be at least partially oxizable in the primary combustion chamber, and be amenable to dispersion within the chamber as discrete particles in the carrier liquid. Typically, the fuel is powdered coal.

By the term "oxidant" there is meant air or oxygen-enriched air.

By the term "carrier fluid" there is meant a gas or liquid, which may be inert or an oxidant. An oxidant is a preferred carrier gas, and water is a preferred carrier liquid.

Preconditioning of the oxidant is accomplished in a short and compact cylindrical precombustor to which all the first oxidant is supplied. The first oxidant is used to combust from about 10% to about 25% of the total carbonaceous feed to form a first reaction product. A second portion of the oxidant enters the precombustor and mixes with the first reaction product to form a hot, oxidant-rich gas stream which is directed in a controlled fashion into the primary combustor. The oxidant-rich gas stream also carries all the residual precombustor fuel and noncombustibles, including still-burning carbonaceous particles dispersed throughout its volume. As a result, pre-combustor exit temperature may range from about 1200° F. to about 2000° F.

The particulate carbonaceous material in the precombustor is introduced, in most instances as solids, into an intense, whirling gas flow field at the head end of the precombustor chamber. Introduction is through a centrally-located injector that produces a conical flow of particulate carbonaceous materials mixing into the oxidant whidrling flow field. The whirling flow field of oxidant and resulting reaction products produces a strong recirculation zone of hot gases and combusting particles, once ignition is achieved. Precombustor geometry provides self-sustaining combustion when air is used as the oxidant and such air is introduced at temperatures of from about 300° to 500° F. or higher. The precombustor is preferably arranged at an angle to the horizontal of about 22½ degrees, with all flows being downward from the head end along this angle to a rectangular exit, to assure that no solids or liquid slag remain in the precombustor. The overall stoichiometry of the pre-combustor is from about 2 to about 5 times the amount of oxygen required for total oxidation of the carbon content of the fuel being fed to the precombustor. This stoichiometry is controlled by adjusting the flow of particulate carbonaceous materials into the oxidant flow to maintain the above exit temperatures.

The heated oxidant and reactants, generated in the precombustor, move through a rectangular exit to a primary combustor of cylindrical geometry. This precombutor-effluent stream is introduced essentially tangential to the interior wall of the primary combustion chamber. The rectangular exit from the precombustor is sized such that the dimension parallel to the primary combustor axis is larger than the dimension perpendicular to the axis of the primary combustor. A length-to-height ratio of 2.5 to 1 is preferred. Preferably, the centerline of the rectangular exit is aligned with the longitudinal axis of the precombustor and is positioned, upstream from the mid point of the primary chamber's longitudinal axis, i.e., about ⅓ to ½ of the distance from the head end to the primary chamber's apertured baffle.

By locating the rectangular exit of the precombustor in the above-described manner, the precombustor effluent causes a whirling motion to be imparted to the flow within the primary combustor. We have found that, by controlling the precombustor exit velocities to the order of 330 fps. through the use of damper plates located within the rectangular exit region of the precombustor, satisfactory combustion may be achieved over a wide range of primary combustor fuel feed rates. The above-described location also causes a division of the effluent into two nearly-equal flows: one flow whirls along the walls towards the head end, while the other flow generally moves helically along the wall of the primary combustor toward its exit. The axial component of the whirling flow toward the head end has a relatively low velocity, in the order of 50 fps. This flow is turned inward at the head-end wall of the primary combustor, and then axially back towards the exit of the primary combutor, all the while following whirling or helical paths. The exit end of the primary combustor is provided with a baffle plate which is located perpendicular to the axis of the primary combustor and which has a generally centrally-located aperture.

The major part of the solid carbonaceous fuel is introduced into the primary combustor, approximately at the center of the head end, through a fuel-injector assembly. This assembly causes the particulate carbonaceous material to be introduced as solids in a gas or liquid carrier, in a conical flow pattern, into the whirling gas flow field. The injector assembly extends into the primary chamber from the head end to a point slightly upstream of the precombustor-exit rectangular opening.

As noted above, the oxidizer inflow to the primary chamber divides into two streams, with about 50% of the precombustor effluent flowing toward the head end, where initial ignition occurs in a fuel-rich reaction zone, with an overall head-end stoichiometry of from about 0.4 to about 0.5. The balance of the incoming oxidizer flows towards the exit end of the primary combustor. The interaction of the conical-pattern fuel injection with the high-velocity whirling flow field provides intimate and rapid mixing of the fuel, oxidizer and products of combustion. As will become more apparent from the detailed description, hereinafter, this provides precise and highly beneficial control of the stoichiometry, compositions and accelerative forces in several portions of the combustion zone and these characteristics are important to achieving the objectives and requirements set forth hereinabove. The bulk of the fuel's combustibles are consumed in flight through the heated oxidizer flow field, giving up energy in the form of heat of reaction and further heating the resultant combustion products. The particles in free flight follow generally helical flow paths towards the exit end of the primary chamber.

In typical operation, a small fraction, preferably not more than about 12% of the carbon content of the fuel reaches the wall of the primary combustor in the form of unburned carbon, normally a combustible char, which continues to be consumed. The liquid slag layer flows helically along the walls of the primary chamber, in response to aerodynamic drag and gravity, toward the exit-end baffle. Typically, combustion of the fuel takes place through a rapid heating of the particles, which causes a gasification of volatile organic, which may be in the order of from 50% to 80% by weight of the total combustibles. The remainder is combusted essentially as particles of char, primarily while in flight.

Fuel-rich gases generated in the head end of the primary combutor, generally flow towards the exit-end baffle while the whirling motion is maintained. That portion of the precombustor effluent which initially divided from the head-end flow proceeds towards the exit-end baffle plate in an outer annular zone with a whirling motion, is forced inward by the baffle plate, and mixes and reacts with fuel and fuel-rich gases, to bring the overall stoichiometry of the primary combustor, up to a level of from about 0.7 to about 0.9, preferably from about 0.7 to about 0.8, and yielding, as the output product of the primary combustor, a stream of hot combustion products rich in CO and $H_2$ and from which most of the noncombustibles have been removed, as liquid slag.

The internal mixing and reaction are further enhanced in the primary combustor by a strong secondary recirculation flow along the centerline of the primary combustor, the flow moving generally along the centerline towards the head end of the primary combustor. This recirculation flow is, also, whirling and, therefore, substantially helical; but its axial component is toward the head end of the primary combustor. It produces a fuel-rich core portion within the primary combustion chamber. The average diameter and mass-flow rate of this reverse-flowing core portion is determined and controlled by the precombustor exit-flow velocity and selection of the diameter of the primary chamber's baffle aperture. Preferably, precombustor exit velocity is about 330 fps, and preferred baffle-opening-diameter to primary-chamber-diameter ratio of approximately 0.5 or more, produces ideal secondary recirculation flows for enhanced control of ignition and overall combustion in the primary chamber.

From approximately the radius of the baffle aperture inwardly, the tangential velocity decreases to a value of essentially zero at the centerline of the primary combustor. This whirling flow field accelerates the fuel particles radially in their early consumption histories, and at the same time enables burned-out particles, down to about 10 microns, to be trapped within the primary combustor as molten slag.

The primary chambers fuel injector assemby is designed to allow for molten slag flow along its exterior surface from the head end, towards the point of injection of the particulate carbonaceous material. This very hot (molten slag) exterior surface on the injector assembly functions as a flame holder to assure immediate ignition of fuel particles as they leave the injector, thereby promoting and maximizing efficient combustion. In operation, the flowing slag along the injector strips off short of the point of solid particle injection, and provides small-point centers of intense radiation and ignition of the head-end-generated fuel-rich gases.

When a gaseous carrier fluid is used, the particulate fuel is carried into the primary combustor in dense-phase transport, wherein the solids-to-carrier fluid ratio at normal power levels is in the range from about 3 to 1 to about 10 to 1 by weight. When the fuel is fed as a liquid slurry, fuel to carrier fluid weight ratios of about 2:1 or higher may be used. The primary chamber's products of combustion are sufficiently hot to maintain a molten slag layer at a temperature above the slag-fusion temperature. Accordingly, slag flows freely along the walls of the primary chamber. Coolant flow to the metal walls is controlled. Particulate fuel mass-flow rate is controlled. The mass flow rate and velocity of oxidizer from the precombustor are controlled. Coordinated regulation of these independent variables keeps the primary combustion zone temperature in a range such that slag vaporization is avoided, a protective slag layer is maintained on the metal walls and liquid slag flows continuously, over that slag layer, toward the slag disposal subassembly. Fuel-rich combustion in the head-end region and the core portion facilitate $NO_x$ control down to environmentally acceptable levels.

Preferably, the walls of the primary chamber are made of water-cooled, tube-and-membrane construction, with a generally circumferentially-directed winding of the tubing. The tube-and-membrane structure is further equipped with slag-retaining studs. The containment walls are initially lined with a sacrificial refractory, applied at a nominal thickness of about 0.5 inch and maintained by studs. In operation, the refractory employed causes the molten slag to tightly adhere to the refractory in a thin frozen layer, with the remainder of the slag flowing over the frozen-slag layer. After long periods of operation this refractory material is eroded away, i.e. sacrificed. But any portion thereof which is so eroded is immediately replaced by congealing slag. This combination of refractory and frozen and molten slag layers provide thermal and chemical protection to the welded tube-and-membrane wall structure. Local slag flow provides for self-replenishment of any lost refractory. Design of the cooling circuits provides for a metal wall temperature of from about 325° to about 600° F., which precludes condensation of acidic compounds and thereby minimizes corrosion. Slag-fusion temperature may be reduced further, for some coals, by providing for in-situ capture of sulfur compounds as described in detail in copending application Ser. No. 670,411.

The longitudinal axis of the primary combustion chamber is positioned, preferably, at an angle of about 15 degrees with respect to horizontal, to insure that proper slag flow occurs, avoiding accumulation of excessive quantities at the bottom of the chamber. The slag generally is driven in a helical pattern towards the exit-end baffle along the wall of the primary combustor. As the slag flow builds up along the wall, a larger portion of the molten slag flows to the bottom of the primary combustor, since the gravity forces exceed the aerodynamic forces. The bottom-collected slag flows towards the baffle. The baffle plate has a centrally-located aperture and a rectangular, keyhole-like opening extending from the aperture to the bottom wall of the primary chamber. This rectangular slot enables slag flow through the baffle plate, adjacent to the bottom wall of the chamber. When burning 200-mesh coal, about 80% to 95% of the noncombustible content of the coal is removed from the gaseous product stream, captured as liquid slag, and disposed of by way of a slag-tapping subsystem located downstream of the key-hole slotted baffle.

By use of a primary combustor length-to-diameter ratio of, nominally, 2 to 1; a baffle diameter-to-primary chamber diameter ratio of 0.5 or more, and with essentially free-flight burning of 200-mesh coal, as described herein, virtually no loss (carryover) of unburned carbon out of the primary chamber is experienced. The combustion products and liquid slag from the primary combustor pass into a preferably cylindrical slag-recovery chamber. The slag-recovery unit comprises a short length-to-diameter chamber having diameter approximately equal to that of the primary chamber. At its bottom is a slag-tapping aperture. At the top is a circular aperture, with a transition geometry arranged at essentially perpendicular with respect to the centerline of the slag-recovery chamber. From this aperture, at the top of the slag-recovery chamber, extends an exit flow conduit to carry the fuel-rich gases on to their ultimate use. This conduit leaves the slag-recovery section at an angle close to vertical, and extends for about one to two length-to-diameter ratios (one being preferred) before turning the combustion-products stream horizontally towards its ultimate use. The slag-recovery unit additionally provides a short distance between the primary chamber's baffle and the vertical-exit aperture, such that a large portion of any residual slag droplets in the gaseous-products stream are captured on the walls of the slag-recovery section. The vertical exit enhances gravity settling of any captured slag particles. Placing the slag-tap aperture substantially opposite the vertical exit enhances internal thermal radiation to the slag-tap to aid in maintaining good slag flow through the slag-tapping aperture into the slag removal tank.

The slag-recovery section, in conjunction with the baffle plate, also provides the source of the hot recirculation gases which flow helically back into the core portion of the primary combustion zone. The diameter of this recirculation, hot-gas core portion is normally about 70% to about 75% of the diameter of the aperture of the primary chamber's baffle plate. This results in increased tangential and axial velocity of the exiting combustion-products stream at the baffle's aperture. Slag droplets which are in this flow are further accelerated towards the wall of the slag-recovery chamber for capture as molten slag. More importantly, this core portion provides a relatively less turbulent region into which additives can be introduced for capturing potential air pollutants, such as sulfur compounds. It provides for the optimum placing of an injector for sorbents for sulfur-emission control. Injection of sorbents into this reverse-flow core portion, from a point along the centerline of the primary combustor near the baffle aperture, provides excellent thermal preconditioning, as well as chemical preparation, of the sorbent. The reverse-flow flow field carries a major portion of the sorbent into the core portion of the primary combustion zone where the sorbent reacts with sulfur compounds in a fuel-rich environment. Efficient use of sorbent results in a recovery percentage as high as 60% to 70% of the sulfur content of the fuel.

In the practice of our invention, operating at an overall primary-chamber stoichiometry of about 0.75 produces nitrogen-oxide emission levels in the range of 250 to about 300 ppm. This enables our system to conform to clean-air regulations without resorting to expensive stack-gas cleanup measures.

Our invention utilizes fluid and combustion-reaction principles which make possible confident scaling from one power size to another. We have built apparatus having power capacities up to 170 million BTU/hr., utilizing the same scaling principles. As an example of these scaling principles, cross-sectional dimensions of the precombustor, the primary combustor, and the slag-recovery chamber scale approximately directly as the square root of the desired power capacity. At sizes of commercial interest, the length-to-diameter ratios are held constant at about 3 to 1 for the precombustor, about 1.5 to 2 to 1 for the primary combustor, and about 1 to 1 for the slag-recovery unit. The nearly-vertical exit conduit has a length-to-diameter of about 1 to 1 to provide for final slag capture and conducting the hot exhaust gases to any specific end-use apparatus. The precombustor's rectangular exit is designed such that the exit-height to primary-combustor-diameter ratio is from about 0.2 to about 0.3, allowing the width of the rectangular exit to be adjusted to produce a nominal inlet velocity of 330 fps, at a temperature of from about 1200° to about 2000° F. The inlet with sliding damper system also aids in achieving turn-down ratios of 3 to 1, in order to accommodate variable demands at the point of use. Turndown is accomplished by throttling the oxidant flow and particulate carbonaceous material flow in direct, or nearly-direct, proportion in the precombustor and by throttling of the particulate carbonaceous material flow into the primary combustor.

For input air flow, the system efficiently utilizes a conventional fan system providing input oxidant at an input pressure of approximately 25 to 45 inches of water. This makes our apparatus directly adaptable to existing end-use equipment, such as industrial furnaces and electric-utility boilers originally designed and constructed to burn oil or natural gas, as well as for new designs of boiler plants where atmospheric-pressure combution is specified. Coal/water slurry ratios of approximately 70% solids to 30% liquid, have been successfully combusted.

Figure 2:
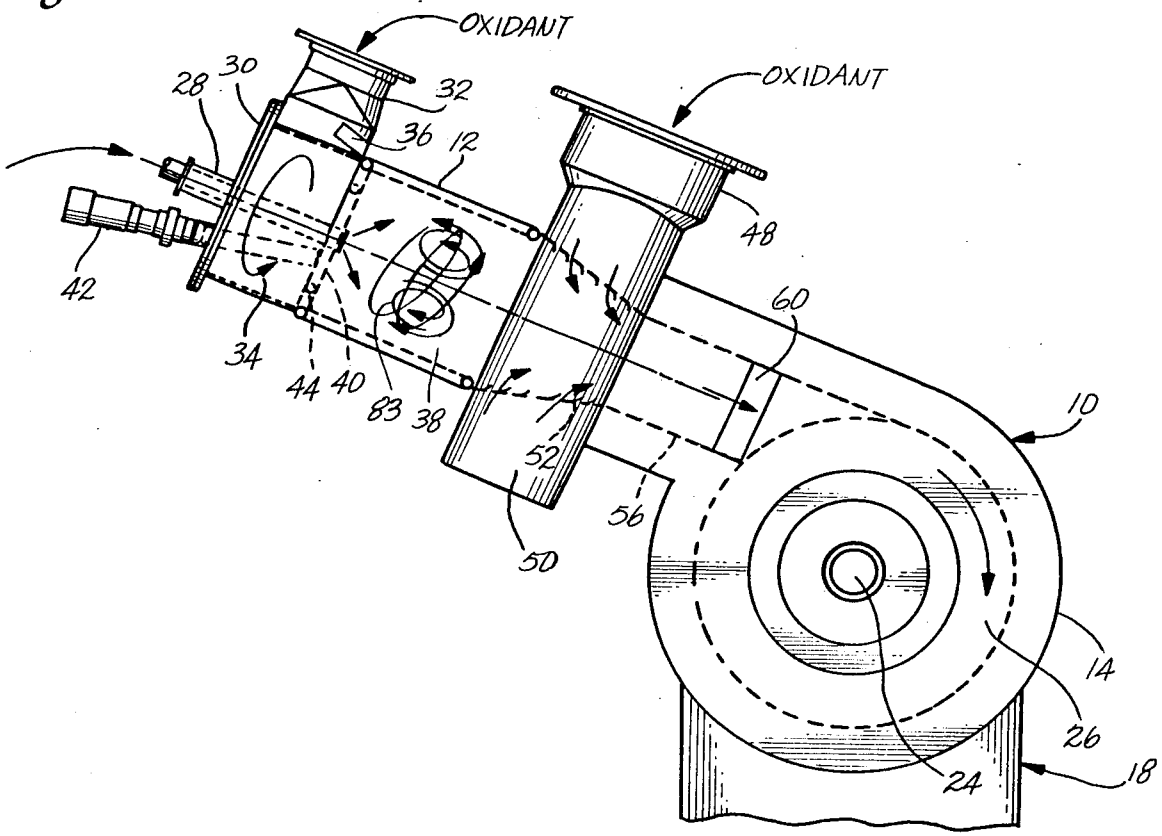
FIG. 2 illustrates the precombustor.
Figure 3:
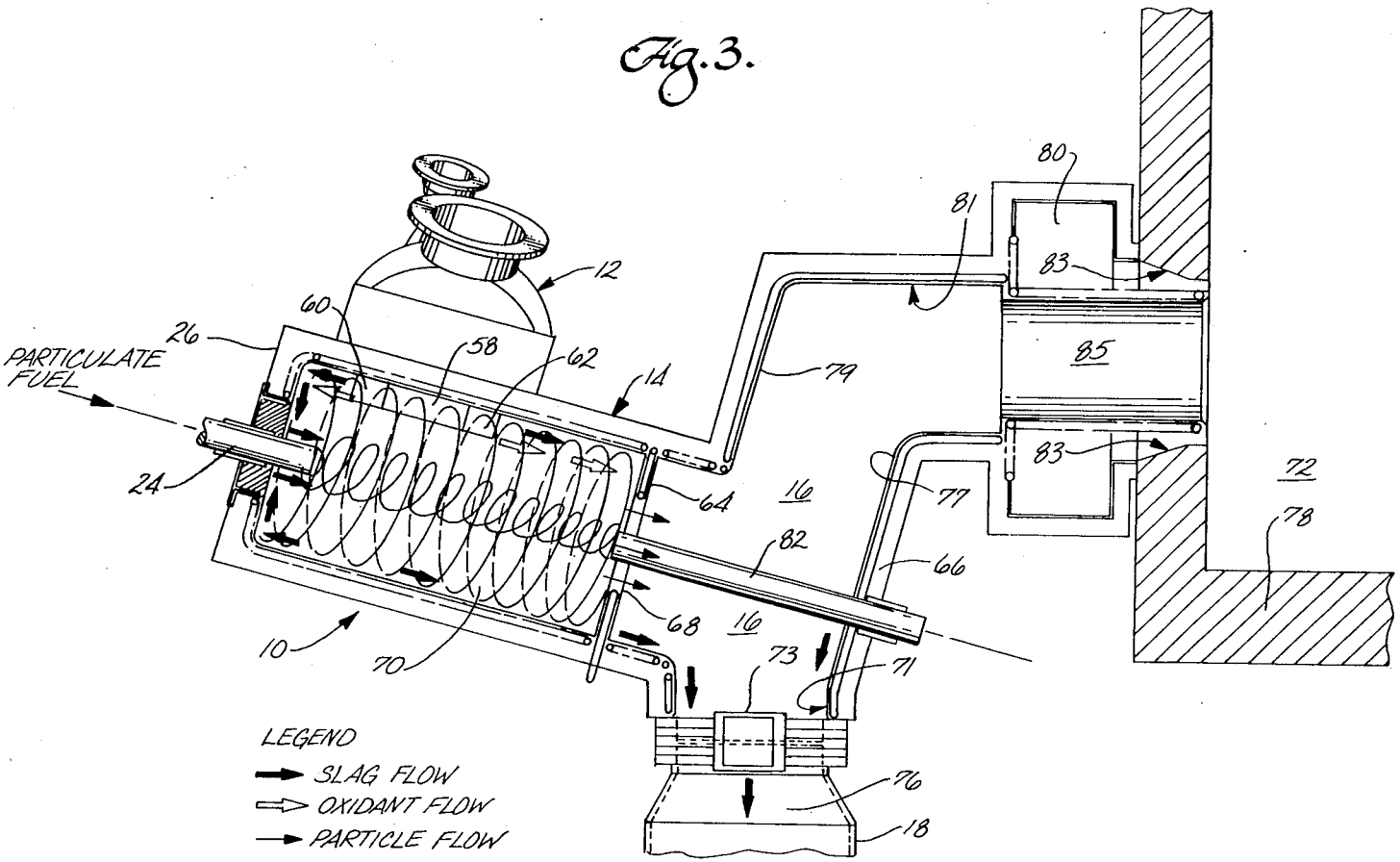
FIG. 3 illustrates the primary combustor, slag recovery and collection, combustion-products conduit and secondary burner.

With reference now to FIGS. 1, 2 and 3, slagging combustor 10 is comprised of precombustor section 12, primary combustion chamber 14, and slag recovery chamber 16 cooperating with a slag collection subsystem 18. A carrier fluid which may be gas, vapor or liquid, is used to transport particulate carbonaceous fuel from reservoir 20 by line 22 to injector assembly 24 positioned in endplate 26. In typical operation, from about 75% to about 90% of the fuel is delivered to primary combustor 14 and the balance to precombustor 12, by dense-phase transport means, not shown.

Fuel is fed to precombustor 12 through nozzle 28. Precombustor 12 is essentially a cylindrical structure closed on one end by end-closure plate 30, and through which nozzle assembly 28 extends. An oxidant flow, preferably preheated to a temperature of from about 300° to about 500° F. or higher, is introduced into mixing room zone 34 by way of duct 32, tangentially attached to precombustor 12. The tangential introduction of oxidant imparts a whirling motion in zone 34. The whirling motion of oxidant flow may be accentuated by a damper plate 36 to increase oxidant velocity through aperture 40 of baffle 44 into combustion zone 38 of precombustor 12. The diameters of zones 34 and 38 are, typically, identical. Fuel-injection nozzle assembly 28 extends into precombustor 12 at least to, and preferably through, aperture 40, to a position such that no reaction takes place in zone 34. A suitable ignition system 42 is inserted through end plate 30 and is positioned to provide initial ignition of oxidant and the particulate fuel. The particulate carbonaceous material and oxidant are reacted in zone 38 to an initial overall stoichiometry of from about 0.5 l to about 1.5 times the amount of oxygen required to convert all carbon present to carbon dioxide, thereby producing a stable reaction temperature which is typically near the adiabatic flame temperature for the mixture of oxidant and carbonaceous material.

Typical tangential velocities of oxidant flow in zone 34, are in the order of about 150 fps. Damper plate 36, located in duct 32, serves as a means for maintaining desired tangential velocities in zone 34 as demanded power ratings change. The diameter of aperture 40 in baffle 44 is preferably about one half of that of precombustor 12. The whirling motion continues into combustion zone 38, and serves to stabilize the combustion therein.

Additional oxidant is introduced into precombustor 12 via duct 48, which opens into a surrounding plenum 50, which encloses a distribution network 52. This additional oxidant mixes with the hot reaction products hydrocarbon and residual oxidant from zone 38, to produce a stream of reaction products that passes through duct 56, which changes the cylindrical cross-section to a rectangular cross-section. This stream flows through aperture 58 tangentially into primary combustion chamber 14. To control the velocity of the precombustor's product stream, duct 56 is equipped with two damper plates 60 and 62, which control the effective opening of rectangular aperture 58. The mixing of secondary oxidant with the reaction products of zone 38, produces an overall reaction product stream having a temperature of from about 1200° to about 2000° F. The stream is oxidant-rich, normally containing from about 2 to about 5 times the amount of oxygen necessary to fully oxidize all of the fuel fed to nozzle 28.

The primary combustion chamber 14 is closed at its head end by end wall 26, and defined at its exit end by apertured baffle 64. Particulate carbonaceous material, along with its carrier fluid, is introduced through fuel injector 24, which is located, preferably, on the axis of primary combustor 14 in end wall 26. Fuel injector 24 extends through end wall 26 to a position such that the particulate fuel and its carrier fluid are injected into combustion zone 70 at a location just upstream from the oxidizer inlet aperture 58. The stoichiometry in zone 70 is controlled by the flow rates of particulate carbonaceous material and carrier fluid, and oxidizer flow from aperture 58. Combustion occurs under conditions wherein the oxidant feed is from about 0.7 to about 0.9 of balanced stoichiometry, preferably from about 0.7 to about 0.8. The tangentially introduced oxidizer stream, flowing in through tangential inlet 58, provides a strong whirling flow in zone 70. Aperture 68 in baffle 64 is preferably a keyhole-like configuration to facilitate the flow of molten slag along the bottom chamber 64, through the slot at the bottom of aperture 58, and into the slag-recovery section. The area ratio of baffle 64 to aperture 68 is selected from a range of from about 2 to about 4, and maintains a desired whirling and centrifuging action in zone 70. A nominal tangential flow velocity for reaction products into zone 70, of from about 250 to about 400 fps, preferably about 330 fps, is also important to the whirling and centrifugal flow fields to maintain desired operation. Whirling flow in zone 70 imparts a strong centrifuging force on noncombustible and nongaseous products created from the reaction of the feed streams. This forces substantially all liquid and solid noncombustibles, and any noncombusted combustibles, to the wall of primary chamber 14 in the form of molten slag. Molten slag in primary chamber 14 flows towards aperture 68, in response to the combination of aerodynamic drag force and gravity. The primary chamber is coupled to a slag-recovery section 18. Molten slag, which enters section 16 via the keyhole-like aperture 68, flows into duct 71 and through aperture 73 into slag collector 76. End wall 66 serves to collect free-flight large slag particles for delivery to collector 76, as do the surfaces of ducts 77 and 79.

Little, if any, combustion takes place in slag recovery section 16. The stream of combustion products from primary combustor 14, is further stripped of molten slag by passing upwardly along duct 77, which is substantially vertical and has a diameter such that bulk flow velocity of the gas stream is on the order of from about 100 to 150 fps, preferably about 125 fps. These relatively low velocities assure that aerodynamic-drag forces applied any large slag droplets are small enough to be overcome by gravity. Also, molten slag flows downwardly along the walls 77 and 79 to the bottom of section 18, comprising slag-tap aperture 73, located in short coupled duct 71 and communicating with slag reservoir 76. The gaseous reaction products now substantially cleaned of molten slag, ash and particulates, flow nearly vertically up conduit 77, for a distance of approximately one to two diameters thereof, and are then turned nearly horizontal by duct 81, through which the gaseous combustion products are carried to their ultimate use point in secondary combustion zone 72 of furnace 78. Depending on the specific end-use, supplementary oxidant (e.g. air) is introduced into the combustor-effluent stream from plenum 80 through annular duct 83. Thus, combustion is completed in zone 72 of end-use furnace 78. The ultimate end use may be, for example, an electric-utility boiler plant or an industrial boiler or furnace for supplying process heat. The stoichiometry of the overall product stream at conduit 85 is the same as that at the exit end of primary combustor 14. All oxidant necessary to complete combustion in zone 72 comes from plenum 80.

With reference again to FIG. 2, operation of precombustor 12 involves tangential flow of oxidant into zone 34, with the injection velocity being, nominally, about 150 fps. The swirling flow increases in velocity as the oxidant passes through aperture 40 in baffle 44 and decreases again in zone 38. The particulate carbonaceous fuel and carrier fluid are introduced into zone 38 at an angle of from about 45 to about 90 degrees with respect to the centerline of precombustor 12. The injected fuel and oxidizer flow fields cause a strong toroidal recirculation. This carries hot combustion gas toward injector nozzle 28, producing an intense combustion zone in the head end of zone 38. While fuel conversion is high, it is not necessary that the combustion be complete in precombustor 12. Instead, it is preferred to control the system so that the precombustor outlet temperature at aperture 58 is from about 1200° to about 2000° F. Oxidant entering plenum 50 is radially bled into the transition zone formed by oxidant distribution grid 52, as illustrated by the small flow vectors, and mixes with the reactant flow from zone 38 into duct 56. Thus, the precombustor subassembly 12 feeds to primary combustor 14 a high-temperature, high velocity stream of oxidizer suitable for generating a swirling, quasi-helical flow field adjacent to the walls in primary combustor 14. Precombustor volume, diameter and length are selected such that little, if any, slag is collected on the wall of the precombustor. Further, precombustor 12 is tilted at an angle with respect to the horizontal to assure that all reaction products in the form of solids and fluids are discharged to primary chamber 14.

Figure 4:
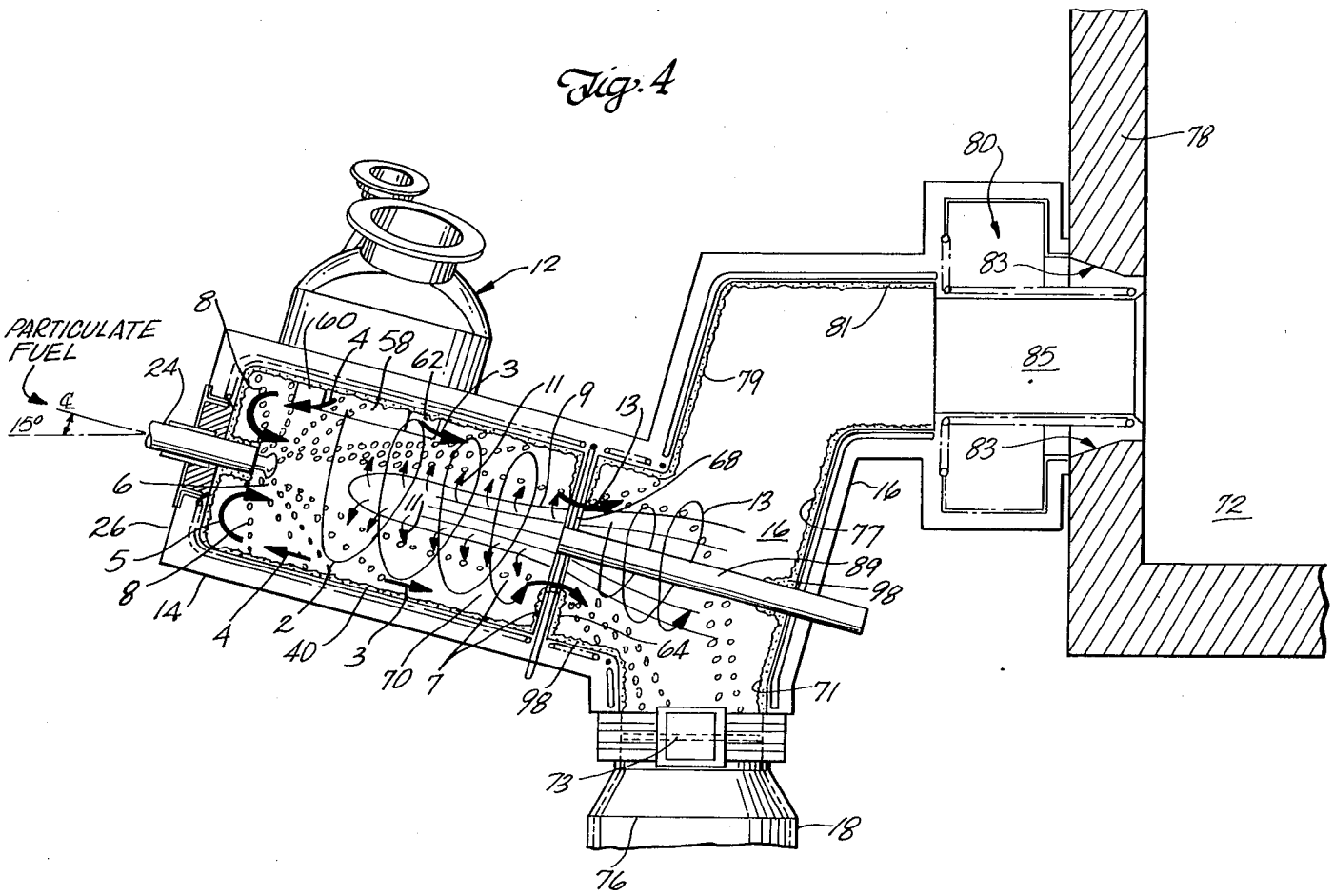
FIG. 4 illustrates in more detail the interaction of reactants and reaction products in the primary combustor and the expansion chamber.

The interaction of the flow fields in primary combustor 14 and slag-recovery chamber 16 is illustrated in greater detail in FIG. 4. The flow fields are complex, vary as a function of time, and somewhat turbulent; however, FIG. 4 illustrates macroscopically the time-averaged conditions and performance. The oxidizer stream from precombustor 12 enter primary combustor 14 in a tangential flow through aperture 58 and create a generally whirling flow 2. Superimposed on whirling flow field 2 are several important secondary flows. The gaseous part of the stream from aperture 58 divides into two substantially-equal halves: one portion flows more-or-less helically, adjacent the inside walls, toward baffle 64; the other portion flows generally toward the head end 26, whirling near the walls and turning back at the head end as indicated, generally, by vector 5. Powdered fuel and carrier fluid are injected from centrally-located fuel-injector 24 in a substantially conical pattern having a nominal angle of from about 45 to about 90 degrees with respect to the longitudinal axis of primary combustor 14. The particulate fuel/carrier gas ratio weight/-weight, is in the range from 3 to 10; preferably close to ten when the system is operating at rated power capacity. The input fuel and carrier gas flow velocity is about 50 to 200 feet/second. The oxidizer flowing from precombustor 12 provides, at its introduction temperature, the primary source of ignition for the injected fuel, normally injected at a size distribution ranging from as small as a few microns to as large as 150 microns for a typical 200-mesh coal. Preferably, the mean mesh size is about 75 microns with a top size of about 125 to 150 microns. The injected particulate fuel and carrier fluid are quickly picked up by strong rotational flow 2, and are accelerated towards the wall of primary combustor 14. At the same time, the axial-flow component acts upon the particulate carbonaceous materials. Combustible volatiles in the order of from 50% to 80% of the mass of typical coals are driven off in the free-flight burning of the particulate carbonaceous materials. Smaller-sized particles burn nearly completely, before they strike the walls, leaving only droplets of molten slag. Only a small fraction of the fuel's carbon reaches the walls, and burns there on the molten slag. The interaction of flow vectors 2, 3, 4 and 5 with the injected particulate fuel, collectively denoted as 6, causes a dispersion of the solid particles to take place, as illustrated. The strength of the internal rotating flow 2 is determined by the velocity of the injected oxidizing effluent and the ratio of the diameter of baffle aperture 68 to the internal diameter of primary chamber 14. For a diameter ratio of 0.5, and a primary combustion chamber length-to-diameter ratio of 2 to 1, the residual molten slag from nominal 10-micron and larger fuel particles, is captured at the baffle. All increasingly larger solid particles are trapped at different impact points on the primary combustor wall surface by other trajectories, as illustrated. The collected slag on primary combustor wall 14 also has its own flow characteristics. In the outer or lower end, near baffle 64, the slag flows as a thin liquid layer in a generally helical pattern towards baffle 64. In the upper or head end of primary combustor 14, the slag flows in a thin layer, partly towards end-closure 26, and radially inward and axially along centrally-located nozzle assembly 24, where the axially flowing slag then strips off and is driven radially outward to the primary combustion chamber wall, again as denoted by slag trajectory 8. The helical-surface slag flow and radially-inward-flowing slag flow at head end are aerodynamically shear-stress driven. When the aerodynamic forces can no longer helically drive all the molten slag flow, a portion of the slag flows along the bottom of primary combustor 14 towards baffle 64. At baffle 64, a keyhole-like slot allows the molten slag to flow into slag-recovery section 16 and, finally, into slag collection section 18. Also at baffle 64, radially-inflowing combustion products cause an aerodynamic shear drag inwardly on a part of the molten slag, resulting in some slag being driven through aperture 68 along with the gaseous products. The strong whirling flow 2, in conjunction with baffle aperture 68, causes a reverse-recirculation core portion to be created approximately within boundary 9. This reverse flow originates at the central part of slag-recovery section 16. Within the volume 70 of primary combustor 14, the reverse flow gases diffuse across boundary 9, as shown by flow vectors 11. On the average this core-portion is relatively fuel-rich compared to the annular portion surrounding it. As fuel-rich gases move across boundary 9, they mix with oxidizer and are further combusted. When the gaseous product flow 13 passes through baffle aperture 68, externally of reverse-flow boundary 9, it has an increased whirling velocity, determined primarily by the velocity of initial oxidant flow 2 in the area of aperture 68. Gaseous product flow 13 also has an axial velocity component that is determined by the amount of flow which must pass through the annular area created by the diameters of baffle aperture 68 and reverse flow boundary 9. On the average, the diameter of reverse flow boundary 9 to the diameter of baffle 68, is about 0.7, with changes in operating conditions causing this to range from about 0.50 to about 0.75.

Preferably, the longitudinal axis of the primary combustor is inclined at an angle of about 15 degrees with respect to the horizontal. This slope provides for satisfactory liquid-slag flow from primary chamber 14 through the keyhole-like aperture 68. Depending on the flow velocities, power levels and operating temperatures chosen for a specific end-use application this inclination may be as small as about five degrees. At greater angles, the amount of slag flowing through the central part of baffle aperture 68 might result in excessive molten slag carry-over, resulting from gaseous product flow stripping molten slag from the edges of baffle 64.

The entire interior surface of the lower portion of slag-recovery section 16, and at least a part of its upper portion, is covered with a thin layer of flowing molten slag. The molten slag flow in primary combustor 14 flows through the keyhole slot in baffle 64 and continues on into slag-recovery section 16 and thence into slag collector 18. The gaseous combustion product exiting from chamber 14 is at its maximum velocity at the aperture 68, and decreases in velocity as the flow expands in slag-recovery section 16.

The division of reaction product flow 2 into two essentially equal parts 3 and 4, results in a stoichiometry in the head-end zone containing the injector assembly 24 of approximately one-half of the overall stoichiometry of primary combustion chamber 14. This low stoichiometry inhibits the formation of nitrogen oxides as the reaction between the heated oxidant product stream and the particulate fuel begins to take place in primary combustor 14. Gaseous species are formed, such as $NH_3$ and HCN, thereby reducing the formation of nitrogen oxides. The overall reducing stoichiometry of primary combustor 14 further inhibits nitrogen oxide formation. In addition, when the overall, space-average stoichiometry within primary chamber 14 is kept within the range from aboout 0.7 to about 0.8, the temperatures inside zone 70 are sufficiently high to keep the slag molten, but not so high as to cause large vaporization of molten slag before it is removed to slag-collection section 18. The overall stoichiometry in slag-recovery section 16 and exit conduits 81, 85 is the same as that in the downstream end of zone 70, thus preserving the low-nitrogen-oxide-emission system desiderata. Overall, this results in reduction of NOx in the stack gases, after secondary combustion, to the order of 250 to 450 ppmv.

During steady-rate introduction of fuel to precombustor 12 through nozzle assembly 28, reaction product flow from opening 58 contains some still-burning particles and numerous burned-out particles in the from of solid fly ash and slag. The fly ash and slag are virtually uniformly distributed through the reaction product and may be hotter than the average of the inflowing oxidant stream. As a result, the oxygen rich stream entering primary combustor 14 functions as a radiant body; and, therefore, the entire head-end portion of zone 70 is exposed to intense radiation from this radiating stream; ignition, combustion and slag flow in the head-end region, in and around injector assembly 24, are thereby enhanced. Similarly, throughout combustion zone 70, particulate loading of the gas flow causes intense thermal radiation to occur; this promotes temperature uniformity within zone 70 and aids in stablizing the overall combustion.

Locating slag-tap aperture 73 directly opposite nearly-vertical ducts 71, 77, and 79, results in increased thermal radiation to slag-tap aperture 73. This increased thermal radiation helps to maintain a good fluid flow of molten slag to slag collector 76.

Figure 5:
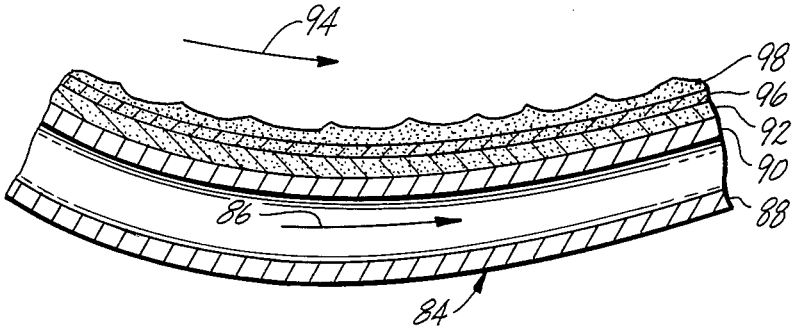
FIG. 5 illustrates the structural arrangement used to provide thermal protection for the walls of the apparatus.

FIG. 5 illustrates a preferred structure for providing thermal and corrosion protection of the walls of the apparatus. Cooling is provided by the flow of coolant 86 at a suitable velocity inside a passage enclosed by surfaces 88 and 90. The passage may be a tube, a double-walled membrane construction or the like. When first constructed, a suitable sacrificial refractory clay 92, such as Missouri Flint Clay, is placed on the hot-gas side of surface 90 in a nominal thickness of about 0.5 inch. In operation, gravitational forces and the hot gas, denoted by vector 94, cause several physical phenomena to occur: molten slag 98 is deposited on the interior surface of the clay 92; heat transfer to the slagging surface occurs by both convection and thermal radiation; the flowing gases 94 aerodynamically drag and shear part of the liquid slag along the interior surface; gravitational forces tend to cause the liquid slag to run to the lowest point on the interior surface; heat transfer to the coolant causes the slag to also form a frozen slag layer 96 over the clay 92; and local heat transfer causes the combination of liquid slag 98, frozen slag 96, and refractory clay 92 to adjust in thickness to accommodate the local heat flux. As time progresses, the original refractory clay is partially or completely replaced by the solid and liquid slag layers. Thus, coolant passage wall 90 is thermally protected, while the coolant passage formed by walls 88 and 90 also operates at an ideal temperature to prevent condensation of acidic compounds and minimize corrosion. Further, flowing molten slag 98 provides a source of insulating material for curing and replenishment for any loss of thermal protection of wall surface 90. Coolant flow 86 is kept in a temperature range of from about 325° to about 600° F. Operating above 325° minimizes acidic corrosion of surface 90. Keeping it below 600° F. guards against hydrogen-sulfide corrosion. Water is preferably utilized as the coolant. Missouri Flint Clay has been found to provide a ready surface 92 for typical slags to adhere to in a tenacious manner, such that the apparatus described herein may be started up and shut down without concern for loss of thermal protection, so long as clay layer 92 is initially properly bonded onto and retained on coolant passage surface 90.

Figure 6:
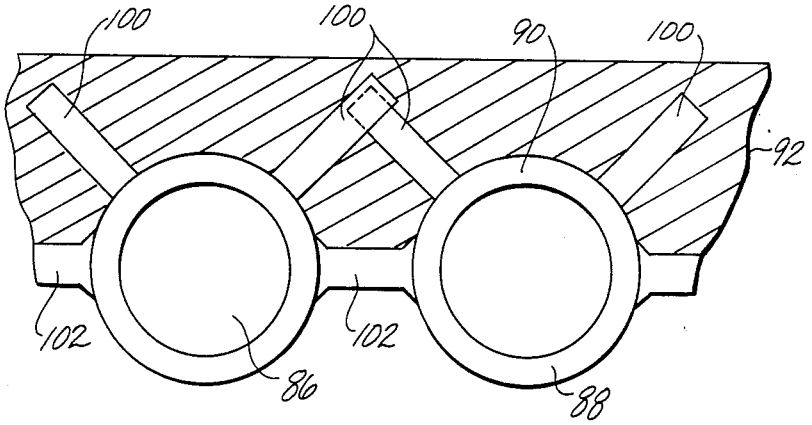
FIG. 6 shows details of tube-and-membrane construction for the containment walls of the apparatus.

FIG. 6 illustrates the presently preferred wall construction and arrangement for securely retaining refactory and/or slag. The coolant passage surfaces 90 and 88 are the interior and exterior surfaces of a cylindrical metal tube through which coolant flow 86 moves. Attached, by welding to surface 90, are studs 100, which are staggered at nominal $1\frac{1}{4}$-inch centers along the coolant passage length, in rows spaced about $\frac{7}{8}$-inch apart. The sacrificial clay 92 is initially formed into and around the stud pattern.

FIG. 6 also illustrates the tube-and-membrane construction utilized in the containment walls of precombustor 12, primary combustor 14, and slag recovery chamber 16. Each tube, made up of surfaces 88 and 90, is joined to the next tube by a full-penetration weld at mid-diameter with membrane 102. The tube-and-membrane construction maintains an adequate wall temperature, even in the case of local loss of slag and/or refractory thermal protection.

Figure 7A:
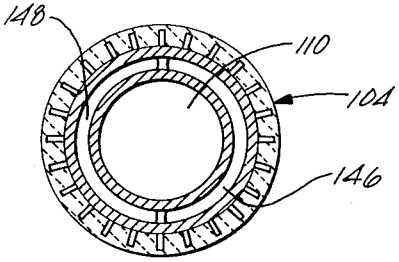
FIGS. 7 and 7A show the hot-sleeve injector assembly.
Figure 8A:
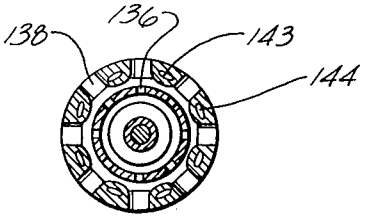
FIGS. 8 and 8A show a fuel injector assembly suitable for firing with slurry.
Figure 7:
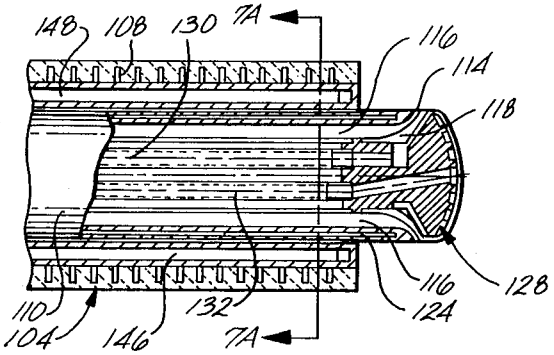
Figure 8:
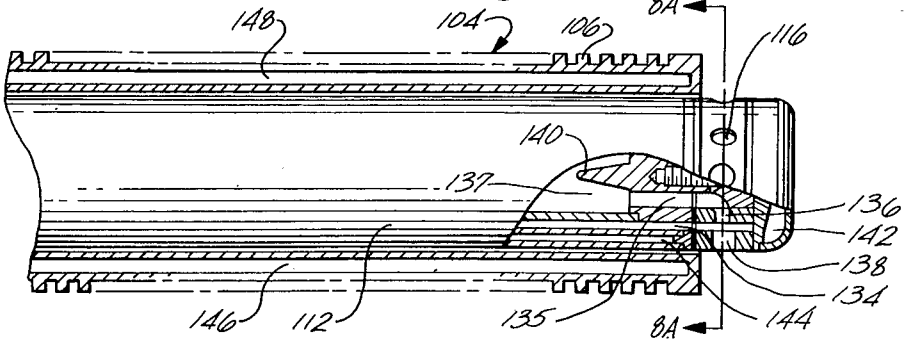

Ignition and stability of the combustion in zone 70 of primary combustor 14, are enhanced by the use of an externally-hot fuel injector, examples of which are depicted in FIGS. 7, 7A, 8 and 8A. A hot exterior is achieved by placing the primary injector assembly inside a sleeve 104. As shown in FIGS. 7 and 7A, the injector is a coaxial device suitable for feeding dense-phase powdered coal with carrier gas. In FIGS. 8 and 8A, the injector assembly is an atomizer for carbonaceous particles suspended in a liquid, for example coal-water slurry.

With reference to FIGS. 7, 7A, 8 and 8A, sleeve 104 is shown in longitudinal cross-section, while the injectors are shown in partial cross-section. Sleeve 104 may, as shown in FIG. 8, be notched with rectangular grooves 106, which form circular fins on sleeve 104. Alternatively, pins 108 are shown in FIG. 7. Sleeve 104 is designed with a clearance of about 0.25 inch, to allow pintle 110 or atomizer 112 to slide into sleeve 104. The end of sleeve 104 is in turn positioned to within a range from about 0.25 to 1.0 inch of injection orifice 114 of pintle 110 or ports 116 of atomizer 112, through which the particulate fuel and carrier fluid flow. With reference to FIG. 8, rectangular slots 106 are preferably of nominal dimensions of 0.25 inch by 0.25 inch. Slag forms a frozen layer on the surface of sleeve 104 inside grooves 106 or, as shown in FIG. 7, around pins 108. Molten slag is aerodynamically dragged axially towards the end of sleeve 104, and produces a hot boundary layer at the point of fuel injection that enhances combustion on injection to zone 70 in primary combustor 14.

FIGS. 7 and 7A show a typical cross-section of pintle injector 110. The particulate carbonaceous materials and carrier fluid enter the injector assembly via annular duct 116 and emerge from injection slot 114 at an injection angle of about 60 degrees over surface 118. The entire injector assembly is positioned in end walls 26 and 30. To prevent undesirable caking and tarring effects of the flowing particulate carbonaceous material and carrier fluid, upon exposure to the heat of zones 38 and 70, it is necessary to internally cool injector nozzles 110 and 112 inside the hot reaction environment. With reference to FIG. 7, coolant is provided by passages 124 on the outside of duct 116 and head manifolds 128, through use of supply-and-return ducts 130 and 132. Sealing is provided between the external environment and zones 38 and 70 by means of a suitable gland seal (not shown) which is controlled in leak tightness by any suitable adjustment means.

With reference now to FIGS. 8 and 8A, atomizer 112 may be used for introduction of a slurry fuel in an atomized state. Its operation and maintenance of combustion close to the point of injection of the slurry into zones 38 and 70, are predicated on the use of an atomizing gas, normally an oxidant such as air, which intercepts the slurry in a direction substantially normal to slurry flow, and mixes with and atomizes the slurry to achieve rapid expansion of atomized particles immediately upon ejection from the injector. This promotes combustion immediately adjacent the periphery of the injector.

Atomizer 112 is retained in sleeve 104. The slurry is introduced to the injector through conduit 137 along an axis substantially normal to the direction of ejection from nozzle 112. Atomizing carrier gas, normally the oxidizer such as air introduced by conduit 134, intersects the slurry at the juncture of communicating ports 136 and 138 in a direction substantially normal to the point of travel of the slurry from port 136 to port 138. This causes shear and atomization of the slurry into zone 38 or 70, at close to right angles to their axis.

The introduced slurry is diverted by cone-shaped projection 140 to a plurality of conduits 135 feeding ejector port 136. Ejector port 138 is preferably slightly divergent in the direction of flow, optimally at an angle of divergence of about 5 degrees and of greater diameter than mating ports 136, to account for shearing gas introduction. A coolant such as water is supplied by conduit 140 to manifold 142 and returns by conduit 144. This protects the head of atomizer 112. With reference to FIGS. 7, 7A, and 8, sleeve 104 is independently cooled with a fluid, such as water, which enters by conduit 146 and exits by conduit 148. This protects the pintle and/or the atomizer, and insures a layer of frozen slag on the exterior surfaces of sleeve 104. Typical injection velocities through slot 114 and curves of channels 136, are of the order of from 50 to 200 fps. Suitable life is obtained by using surfaces formed of tungsten carbide, tantalum carbide, or an equivalent wear-resistant material, where a change in flow direction occurs.

The structure, operation and advantages of the externally-hot fuel injectors shown in FIGS. 7, 7A, 8 and 8A are more fully described in co-pending patent application Ser. No. 670,411, entitled "Slagging Combustor with Externally-Hot Fuel Injector," filed concurrently with this application and assigned to the same assignee, which co-pending application is hereby incorporated herein by reference. Also incorporated by reference are co-pending patent applications Ser. No. 670,416, entitled "Slagging Combustor Sulfur Removal," and Ser. No. 670,412, entitled "Carbonaceous Slurry Combustor,". Reference may be had to these co-pending applications for a more specific understanding of how the subject matter thereof may be used in conjunction with our invention.

Figure 9:
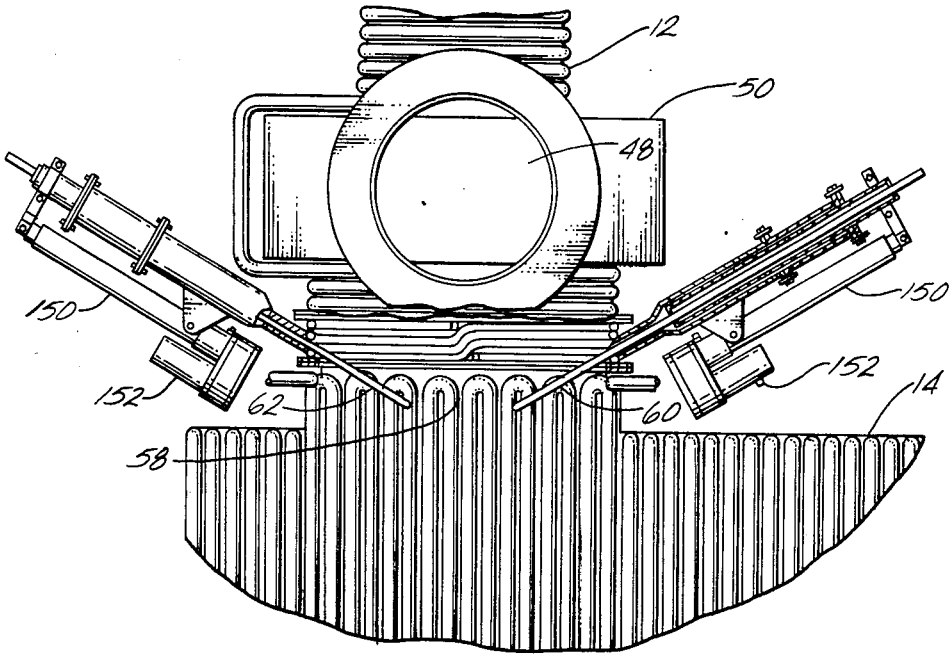
FIG. 9 shows a sectional view of a fabricated assembly at the junction of the precombustor with the primary combustor.

FIG. 9 shows some detail of the tube-and-membrane cooling system of FIGS. 5 and 6, and, in particular, the structural arrangement coupling precombustor 12 to primary combustor 14. Damper plates 60 and 62, which control the velocity and mass flow rate of oxidizer flow into primary combustor 14, are driven by suitable actuators 150 and motors 152. The damper plates are driven in and out to form rectangular opening 58 for introduction of the oxidizer stream from precombustor 12 to primary combustor 14.

The design principles embodied in this invention provide a means for ready scaling to various power levels. Because the reaction processes are essentially intense-volume burning processes, wherein aerodynamic principles control, the sizing is accomplished by the use of cross-sectional flow areas while making minor adjustments on oxidant inlet velocities. The basic scaling relationships are as follows:

1. Precombustor, primary combustor, and slag-recovery cross-sectional areas:

$$\frac{\text{Power of Unit 1}}{\text{Power of Unit 2}} = \frac{[\text{Diameter of 1}]_2}{[\text{Diameter of 2}]}$$

2. Length-to-diameter requirements, L/D:
Precombustor 3:1
Primary combustor (1.5 to 2):1
Slag-recovery section 1:1

3. Baffle area ratio for primary combustor (2 to 4):1

These relationships are tempered only by hardware implementation requirements.

Typical results for sizing of the hardware for a nominal 50-million BTU/hour unit utilizing Ohio #6, 200-mesh coal, are as follows:

| Precombustor | |
|---|---|
| Diameter | 17 inches |
| Length | 55 inches |

| Primary Combustor | |
|---|---|
| Diameter | 34 inches |
| Length | 60 inches |
| Inlet aperture | 25 inches by 10 inches |
| Baffle aperture | 17.125 inches |
| Baffle keyhole | 3 inches wide by 8.417 inches high |

| Slag-Recovery Section | |
|---|---|
| Diameter | 34 inches |
| Length | 60 inches |
| Slag tap | 18 inches |
| Exit Diameter Equivalent | 30 inches |

For a combustion apparatus of the size indicated above, the coal used is preferably 80% through 200 Mesh. For apparatus scaled up to larger power capacities, one may use a some what coarser fuel while still realizing the several described advantages of our invention.

While we have shown and described a specific embodiment of our invention, it is to be understood that various modifications may be made therein without departing from our invention; and it is, therefore, our intent to cover all changes and modifications as fall within the true spirit and scope of our invention.

We claim:

1. In an apparatus for the combustion of particulate carbonaceous fuel in a combustion zone and separation of the slag content of the fuel from the gaseous product of combustion, the combination of:

(a) a metallic, fuel-cooled combustion chamber having its walls maintained at temperatures such that a layer of slag is maintained on the inside surfaces of the walls;

(b) means for injecting oxidizer into said chamber in a manner to provide high velocity swirling flow of a mixture of oxidizer, fuel particles and combustion products within an annular portion of said combustion zone adjacent said inside surfaces;

(c) means for introducing particulate carbonaceous fuel into said chamber at a relatively low velocity compared to that of the oxidizer and in a manner and direction to maintain a relatively fuel-rich stoichiometry within a longitudinally-extending central portion of said combustion zone;

(d) means regulating the fuel input rate relative to the oxidizer input rate for providing rotational flow velocities, stoichiometric conditions and predetermined combustion temperatures within ranges such that most of the carbon contained in the fuel is converted to oxides of carbon and most of the non-combustibles present in the fuel are fused and deposited as liquid slag, thereby being separated from the gaseous products of combustion;

(e) an apertured baffle positioned at the exit end of said combustion chamber, said baffle defining a substantially circular orifice and a slot extending downwardly from said orifice with combustion products exiting from said combustion chamber through said orifice in a high velocity whirling stream and molten slag flowing along the bottom wall of the combustion chamber and through said slot;

(f) a slag-recovery chamber coupled to receive products of combustion from said combustion chamber, said slag-recovery chamber being adapted to operate substoichiometrically; and (g) means for flowing gaseous products from said slag recovery chamber to an associated end-use equipment, said means including means to add supplementary oxidizer to said flowing gaseous products in the region of flow of said gaseous products to said associated end-use equipment.

2. An apparatus in accordance with claim 1 further comprising a coal-fired precombustor and wherein the stoichiometry of combustion in said precombustor is controllable independently of the velocity of the precombustor's products flowing to the primary combustion chamber.

3. An apparatus in accordance with claim 2 wherein stream output temperature of the precombustor is regulated within the range from about 1200° F. to about 2000° F.

4. An apparatus in accordance with claim 2 wherein said precombustor comprises a substantially cylindrical precombustion chamber having a head end and an exit end communicating with the primary combustion chamber, a fuel injector positioned near the center of the head end and extending into said precombustion chamber for introducing particulate fuel into said chamber in a spray pattern diverging toward the cylindrical walls of said chamber and means for introducing oxidizer gas into said precombustion chamber in a manner to provide swirling flow therein.

5. An apparatus in accordance with claim 1 wherein said means for injecting particulate fuel into the primary chamber includes means for introducing said fuel as a flow of solid particles suspended in a carrier fluid and means for regulating the weight-to-weight ratio of said fuel to said carrier fluid independently of the velocity at which said flow is injected into the primary combustion chamber, thereby regulating combustion within the primary chamber to maintain the temperature therein substantially at a preselected temperature.

6. An apparatus in accordance with claim 1 and further comprising:

(a) a coal-fired precombustor for combusting a small fraction of the total particulate fuel to be combusted and producing a high-velocity stream of oxidizer gas mixed with combustion products for injection into the primary combustion chamber; and (b) means for controlling the flow of oxidant and particulate fuel to said precombustor and thereby regulating the temperature of said stream within the temperature range from about 1200° F. to about 2000° F., whereby the efficacy of separation of molten slag from the gaseous products of combustion within the primary combustion chamber is regulated.

7. An apparatus in accordance with claim 1 wherein input velocities, mass-flow rates and temperatures in said combustion chamber are controlled to maintain an elongated combustion zone therein, said zone comprising a relatively oxygen-rich annular region adjacent the walls, and a relatively fuel-rich recirculation zone extending along the centerline of said chamber, whereby a major portion of the carbonaceous fuel is initially combusted in said annular region, substantially all the slag content of the fuel is driven to the walls of the chamber, and substantially all the carbon contained in the fuel is converted to oxides of carbon within throughout residence times of the order of a few hundred milliseconds and before the gaseous products of combustion leave said combustion chamber.

8. An apparatus in accordance with claim 2 wherein the temperature of the precombustor's output stream is regulated to minimize the generation of nitrogen oxides.

9. An apparatus in accordance with claim 2 wherein said precombustor comprises an elongated, substantially cylindrical chamber, a fuel injector positioned near the center of one end and extending into said chamber for introducing particulate fuel suspended in a flow of carrier fluid into said chamber and means for introducing oxidizer gas substantially tangentially into said chamber.

10. In an apparatus for combustion of solid carbonaceous fuel wherein preheated oxidizer gas and particulate fuel are introduced into a substantially cylindrical primary combustion chamber having a head end and an exit end and wherein the input velocities, mass-flow rates and combustion temperatures are regulated to minimize the concentration of volatilized and liquid slag in the output gaseous products of combustion, and wherein the walls of the combustion chamber are maintained within a temperature range such that a layer of solidified slag is retained on the inside surfaces of the walls, the improvement comprising:

(a) means including a precombustor for preheating said oxidizer gas and introducing the preheated oxidizer gas into said chamber in a manner to establish first and second high-velocity flows of a mixture comprising oxidizer and combustion products with said first and second high-velocity flows proceeding respectively toward the head end and the exit end of said chamber;

(b) means for injecting said particulate fuel into said chamber near the center of the head end in a pattern such that substantially all of the fuel particles are intercepted by said flows and at least partially oxidized before reaching the walls of the chamber;

(c) means for regulating the oxidizer and fuel input velocities and mass-flow rates so that a relatively fuel-rich combustion regime is maintained at the head-end portion of the primary combustion zone within said chamber, a relatively oxygen-rich annular region is maintained adjacent the walls near the exit end, a major portion of the carbonaceous fuel is combusted in said annular region, substantially all the slag content of the fuel is driven to the walls of the chamber, and substantially all the carbon contained in the fuel is converted to oxides of carbon before the gaseous products of combustion leave the exit end of said chamber;

(d) slag recovery and disposition means, comprising an expansion chamber coupled to receive combustion products leaving the primary combustion chamber, said slag recovery and disposition means adapted for collecting substantially all liquid slag entrained in said combustion products having thermal energy-carrying gaseous products, separately collecting and disposing of all slag collected in the system, and conducting thermal energy-carrying gaseous products to an associated thermal-energy utilization zone; and (e) means for introducing supplementary oxidizer to said thermal energy-carrying gaseous products substantially at said utilization zone.

11. An apparatus in accordance with claim 10 wherein the stoichiometry of combustion in said precombustor is controllable independently of the velocity and mass-flow rate of the precombustor's products flowing to the primary combustion chamber.

12. An apparatus in accordance with claim 10 wherein the temperature of the precombustor's output stream is regulated within the range from about 1200° F. to about 2000° F. to optimize stable combustion in the primary combustion chamber.

13. An apparatus in accordance with claim 10 wherein said precombustor comprises an elongated, substantially cylindrical precombustion chamber having a head end and an exit end, a fuel injector positioned near the center of the head end and extending into said chamber for introducing particulate fuel into said chamber in a pattern diverging toward the cylindrical walls of said chamber and means for introducing oxidant into said chamber.

14. An apparatus in accordance with claim 10 wherein said preheated oxidizer gas is introduced in the form of a stream of air mixed with combustion products, said stream having a temperature within the range from about 1200° F. to about 2000° F., and wherein said means for injecting particulate fuel includes means for introducing said fuel as a flow of solid particles suspended in a carrier fluid and means for regulating the weight-to-weight ratio of said fuel to said carrier fluid, thereby regulating combustion within the primary combustion chamber in a manner to maintain the temperature therein substantially at a preselected temperature exceeding 2000° F.

* * * * *